US009900962B1

(12) United States Patent
Peng et al.

(10) Patent No.: US 9,900,962 B1
(45) Date of Patent: Feb. 20, 2018

(54) ILLUMINATION SYSTEM AND ILLUMINATION METHOD THEREOF

(71) Applicants: LITE-ON ELECTRONICS (GUANGZHOU) LIMITED, Guangzhou (CN); Lite-On Technology Corporation, Taipei (TW)

(72) Inventors: Yao-Chi Peng, Taipei (TW); Shih-Ming Huang, Taipei (TW); Chien-Lung Wang, Taipei (TW); Ming-Chun Wu, Taipei (TW); Po-Chang Li, Taipei (TW)

(73) Assignees: LITE-ON ELECTRONICS (GUANGZHOU) LIMITED, Guangzhou (CN); Lite-On Technology Corporation, Taipei (TW)

( * ) Notice: Subject to any disclaimer, the term of this patent is extended or adjusted under 35 U.S.C. 154(b) by 0 days.

(21) Appl. No.: 15/404,204

(22) Filed: Jan. 12, 2017

(30) Foreign Application Priority Data

Nov. 10, 2016 (CN) ..... 2016 1 0988651

(51) Int. Cl.

| | |
|---|---|
| ***H05B 37/02*** | (2006.01) |
| ***H05B 33/08*** | (2006.01) |
| *F21S 8/08* | (2006.01) |
| *F21Y 115/10* | (2016.01) |
| *F21W 131/103* | (2006.01) |

(52) U.S. Cl.
CPC ..... *H05B 37/0227* (2013.01); *H05B 33/0848* (2013.01); *H05B 33/0869* (2013.01); *F21S 8/085* (2013.01); *F21W 2131/103* (2013.01); *F21Y 2115/10* (2016.08)

(58) Field of Classification Search
CPC ..... H05B 37/0227; H05B 33/0848; H05B 33/0869; F21Y 2115/10; F21S 8/085; F21W 2131/103
USPC ..... 315/151
See application file for complete search history.

(56) References Cited

U.S. PATENT DOCUMENTS

| | | | | |
|---|---|---|---|---|
| 9,176,485 | B2 * | 11/2015 | Krumm | G05B 15/02 |
| 2010/0283393 | A1 * | 11/2010 | Boleko Ribas | H05B 37/029 315/152 |
| 2011/0109228 | A1 * | 5/2011 | Shimomura | H05B 37/0245 315/113 |
| 2012/0153868 | A1 * | 6/2012 | Gu | H05B 37/0227 315/307 |
| 2014/0288382 | A1 * | 9/2014 | Lemmens | A61B 5/16 600/300 |
| 2016/0007426 | A1 * | 1/2016 | Ashdown | H05B 37/0227 700/90 |
| 2016/0050397 | A1 * | 2/2016 | Di Giamberardino | H05B 37/0227 315/149 |
| 2017/0108236 | A1 * | 4/2017 | Guan | F24F 11/0012 |

* cited by examiner

*Primary Examiner* — Don Le
(74) *Attorney, Agent, or Firm* — JCIPRNET

(57) ABSTRACT

An illumination system and an illumination method thereof are provided. An environmental condition of a position of an illumination apparatus is detected, so as to produce an environmental information. A corresponding illumination result prediction model is selected according to a first environmental information. An illumination character of an illumination light is adjusted according to the illumination result prediction model and the first environmental information.

16 Claims, 7 Drawing Sheets

ILLUMINATION SYSTEM AND ILLUMINATION METHOD THEREOF

CROSS-REFERENCE TO RELATED APPLICATION

This application claims the priority benefit of China application no. 201610988651.5, filed on Nov. 10, 2016. The entirety of the above-mentioned patent application is hereby incorporated by reference herein and made a part of this specification.

FIELD OF THE INVENTION

The invention relates to an illumination system and an illumination method, and more particularly relates to an illumination system and an illumination method adapted to adjust illumination effects.

DESCRIPTION OF RELATED ART

Regulations and requirements for illumination effects of street lamps vary among different countries; for example, the performance of an illumination value, a luminance value, glare, and other optical properties is regulated by rules of law, wherein the luminance value directly influences visual perception of drivers; therefore, the performance of the luminance value is listed as a critically controlled item in a plurality of regulations. Since the performance of the luminance value is closely related to a material used by a road surface and reflectivity, the actual luminance value may be changed in response to weather conditions. In rainy days, higher reflectivity on a road surface is always observed, which easily causes lower light uniformity and generates glare as a result and further jeopardizes drivers' safety. A fixed light distribution design is adopted for light patterns in traditional street lamps, and no adjustment can thus be made corresponding to various weather and environmental conditions.

SUMMARY OF THE INVENTION

The invention provides an illumination system and an illumination method thereof for performing an immediate illumination adjustment corresponding to an environmental condition, so as to achieve default illumination effects precisely and enhance an illumination quality significantly.

In an embodiment of the invention, an illumination system is provided, and the system includes a first illumination apparatus, a first environmental detection unit, and a control circuit. A first illumination light irradiating a first target region is provided by the first illumination apparatus. An environmental condition of a position of the first illumination apparatus is detected by the first environmental detection unit, so as to produce a first environmental information. A control circuit is coupled to the first illumination apparatus and the first environmental detection unit and configured to select a corresponding illumination result prediction model according to the first environmental information and adjust an illumination character of the first illumination light according to the illumination result prediction model and the first environmental information, such that an illumination result of the first target region complies with a default specification, wherein the default specification includes at least one illumination parameter.

In an embodiment of the invention, a second illumination apparatus is further included in the illumination system, disposed at a default distance from the first illumination apparatus, and configured to provide a second illumination light irradiating a second target region. An environmental condition of a position of the second illumination apparatus is detected by a second environmental detection unit, so as to produce a second environmental information and transmit the second environmental information to the first environmental detection unit. The control circuit is configured to choose a corresponding illumination result prediction model according to the first environmental information and the second environmental information and adjust an illumination character of the first illumination light according to the illumination result prediction model, the first environmental information, and the second environmental information, such that an illumination result of the first target region complies with a default specification.

In an embodiment of the invention, the first environmental information includes at least one of a light reflection character of the first target region and a weather condition.

In an embodiment of the invention, the first environmental detection unit includes an image capturing apparatus, and the control circuit controls the image capturing apparatus to capture an image of the first target region, obtain a captured image, and compare the captured image with a default image, so as to determine a light reflection character of the first target region and choose a corresponding illumination result prediction model according to the light reflection character of the first target region.

In an embodiment of the invention, the first environmental detection unit includes a humidity sensor.

In an embodiment of the invention, the illumination result of the first target region includes at least one of a luminance and a light uniformity of the first target region, and the control circuit further adjusts the illumination character of the first illumination light according to a change of the at least one of the luminance and the light uniformity of the first target region, such that the illumination result of the first target region complies with the default specification.

In an embodiment of the invention, the illumination character of the first illumination light includes at least one of an angle of incidence at which the first illumination light enters the first target region, a wavelength of the first illumination light, and a light intensity of the first illumination light.

In an embodiment of the invention, an illumination method for an illumination system is provided, and the illumination method includes following steps. A first illumination apparatus is provided to provide a first illumination light to irradiate a first target region. An environmental condition of a position of the first illumination apparatus is detected, so as to produce a first environmental information. A corresponding illumination result prediction model is selected according to the first environmental information. An illumination character of the first illumination light is adjusted according to the illumination result prediction model and the first environmental information, such that an illumination result of the first target region complies with a default specification, and that the default specification includes at least one illumination parameter.

In an embodiment of the invention, the illumination method of the illumination system includes following steps. A second illumination apparatus disposed at a default distance from the first illumination apparatus is provided, wherein a second illumination light irradiating a second target region is provided by the second illumination apparatus. An environmental condition of a position of the second illumination apparatus is detected, so as to produce a second environmental information. A corresponding illumination result prediction model is selected according to the first environmental information and the second environmental information. An illumination character of the first illumination light is adjusted according to the illumination result prediction model, the first environmental information, and the second environmental information, such that the illumination result of the first target region complies with the default specification.

In an embodiment of the invention, the first environmental information includes at least one of a light reflection character of the first target region and a weather condition.

In an embodiment of the invention, steps of detecting the environmental condition include following steps. An image of the first target region is captured for acquiring a captured image. The captured image and a default image are compared for determining the light reflection character of the first target region. A corresponding illumination result prediction model is selected according to the light reflection character of the first target region.

In an embodiment of the invention, the first environmental information includes an environmental humidity.

In an embodiment of the invention, the illumination result of the first target region comprises at least one of a luminance and a light uniformity of the first target region, and the illumination method of the illumination system includes adjusting the illumination character of the first illumination light according to the illumination result prediction model and a change of the at least one of the luminance and the light uniformity of the first target region, such that the illumination result of the first target region complies with the default specification.

In an embodiment of the invention, the illumination character of the first illumination light includes at least one of an angle of incidence at which the first illumination light enters the first target region, a wavelength of the first illumination light, and a light intensity of the first illumination light.

In view of the foregoing, in an embodiment of the invention, the corresponding illumination result prediction model is selected according to the environmental condition, and the illumination character of the illumination light is adjusted according to the illumination result prediction model and the environmental condition, such that the illumination result of a target region complies with the default specification; therefore, an illumination adjustment may be made immediately corresponding to an environmental situation, so as to precisely reach an expected illumination result and further enhance an illumination quality significantly.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
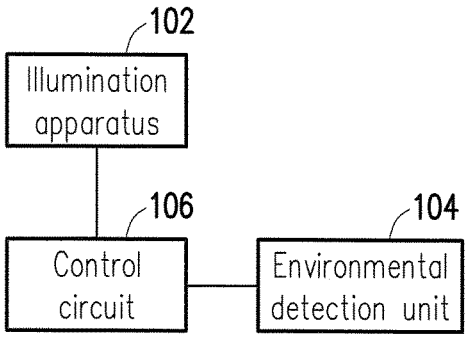
FIG. 1 is a schematic diagram illustrating an illumination system according to an embodiment of the invention.
Figure 2:
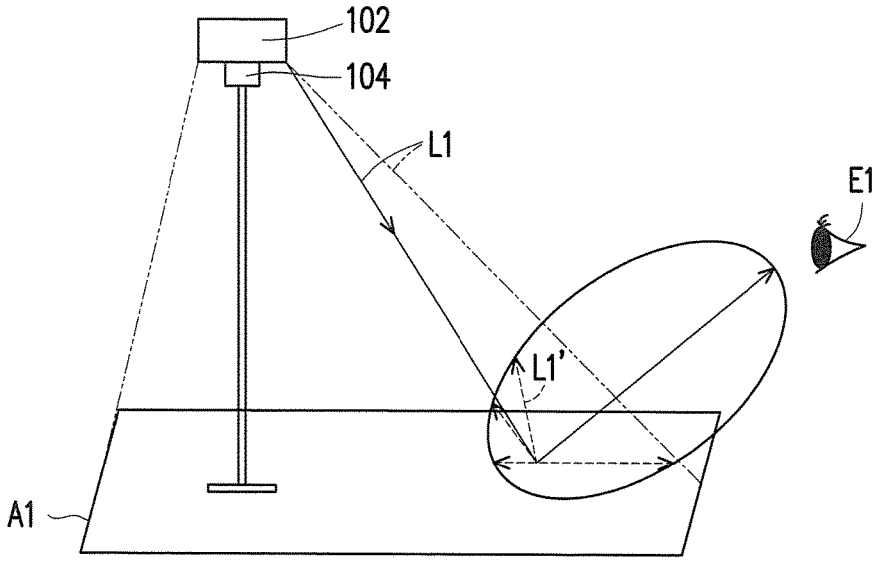
FIG. 2 is a schematic diagram illustrating an illumination system according to another embodiment of the invention.

FIG. 1 is a schematic diagram illustrating an illumination system according to an embodiment of the invention. As shown in FIG. 1, the illumination system includes an illumination apparatus 102, an environmental detection unit 104, and a control circuit 106, wherein the control circuit 106 is coupled to the illumination apparatus 102 and the environmental detection unit 104. In the embodiment, the illumination system is a street lamp illumination system as illustrated in FIG. 2 that is a schematic diagram illustrating an illumination system according to another embodiment of the invention, and the illumination apparatus 102 may provide an illumination light L1 irradiating a target region A1 (the target region refers to a road surface region in the embodiment).

An environmental condition of a position of the illumination apparatus 102 may be detected by the environmental detection unit 104, so as to produce a first environmental information. A corresponding illumination result prediction model may be selected by the control circuit 106 according to the first environmental information, and an illumination character of the illumination light L1 is adjusted by the control circuit 106 according to the illumination result prediction model and the first environmental information, such that an illumination result of the target region A1 complies with a default specification, wherein the default specification includes at least one illumination parameter, such as a luminance, an illumination, an irradiated region, etc. Therefore, when the corresponding illumination result prediction model is selected according to the environmental condition, and the illumination character of the illumination light is adjusted according to the illumination result prediction model and the environmental condition, an illumination adjustment may be made immediately corresponding to the environmental condition, an expected illumination result is achieved precisely, and an illumination quality is significantly enhanced, such that the illumination result of the target region complies with the default specification.

Figure 3:
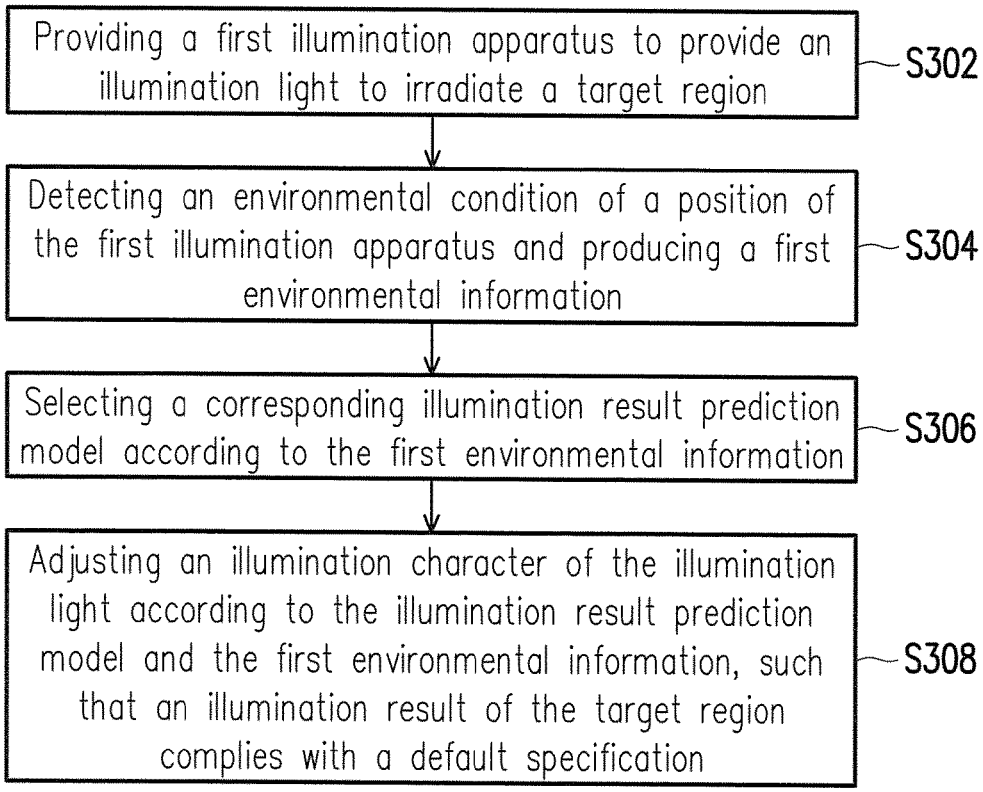
FIG. 3 is a flow chart illustrating an illumination method of an illumination system according to an embodiment of the invention.

FIG. 3 is a flow chart illustrating an illumination method of an illumination system according to an embodiment of the invention. With reference to FIG. 3 and according to the above embodiments, it can be known that the illumination method of the illumination system may at least include following steps. First, a first illumination apparatus is provided to provide an illumination light to irradiate a target region (step S302). Next, an environmental condition of a position of the first illumination apparatus is detected, so as to produce a first environmental information (step S304). Then, a corresponding illumination result prediction model is selected according to the first environmental information (step S306). Finally, an illumination character of the illumination light is adjusted according to the illumination result prediction model and the first environmental information, such that the illumination result of the target region complies with the default specification (step S308).

Figure 4A:
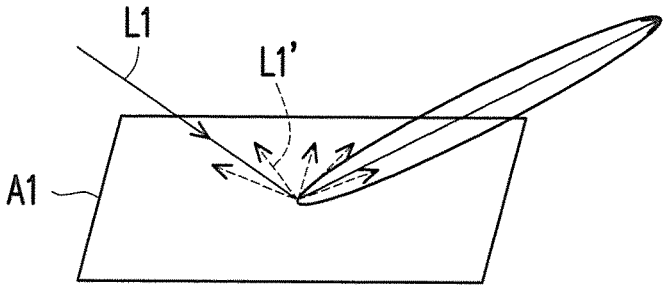
FIG. 4A to FIG. 4C are schematic diagrams illustrating an illumination result prediction models according to the embodiment.
Figure 4B:
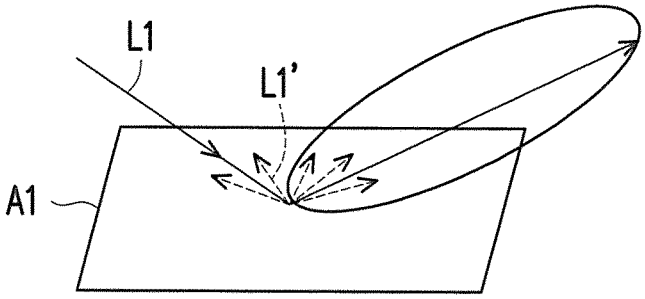
Figure 4C:
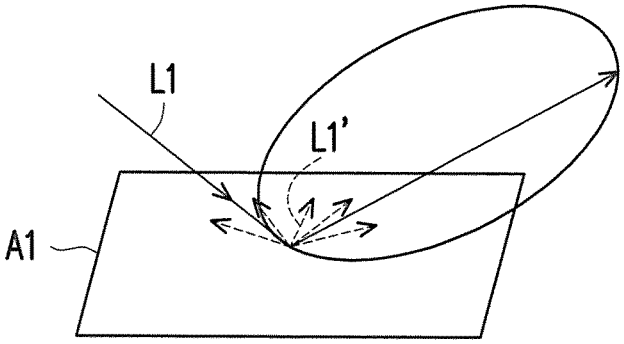

Furthermore, the environmental detection unit 104 may be, for example, an image capturing apparatus, such as a charge coupled device (CCD) camera; however, the invention is not limited hereto, and an image of the target region A1 may be captured by the environmental detection unit 104 for acquiring a captured image (i.e., the first environmental information). Light reflection characters of road surfaces differ under different circumstances, for instance, a light reflectivity of a dry road surface and a light reflectivity of a damp road surface in a rainy day are different, or the light reflectivity may also be affected by degree of roughness or a degree of smoothness of a road surface. FIG. 4A to FIG. 4C are schematic diagrams illustrating an illumination result prediction model according to the embodiment, wherein the embodiment depicted in FIG. 4A to FIG. 4C, FIG. 4A corresponds to the humid road surface (i.e., the target region A1), and FIG. 4C corresponds to the driest road surface as illustrated in FIG. 4A to FIG. 4C. The dryer a road surface is, the more serious the light scattering issue is after the illumination light enters the road surface, and the weaker the light intensity of the reflection light is.

The control circuit 106 may be configured to compare between a captured image and a default image, determine a difference in the luminance of a target region according to a gray scale difference, determine whether glare has occurred according to a light uniformity, further determine a light reflection character of the target region A1, and select an illumination result prediction model corresponding to different circumstances of a road surface. For example, since the higher the dampness of a road surface, the less serious the light scattering issue of the road surface, when the road surface showing different dampness levels is irradiated by the same illumination light, the darker the captured image is, the less the scattering light L1' received by an image capturing apparatus is, the damper the road surface is, and the more easily glare is generated. On the contrary, the brighter the captured image is, the more the scattering light L1' received by the image capturing apparatus is, the drier the road surface is, and the less easily the glare is generated; therefore, a corresponding illumination result prediction model corresponding to the road surface conditions may be selected correctly by the control circuit 106. The illumination result prediction model may predict a situation where a light scatters to every angle; in other words, the control circuit 106 is able to estimate a luminance and a light uniformity of a light entering into human eyes E1 (e.g., a road user's eyes) according to a captured image (including a brightness and a light distribution of the received scattering light L1') captured by an image capturing apparatus, such that an illumination character of the illumination light L1 is precisely adjusted according to the illumination result prediction model and the luminance and the light uniformity of the target region in the captured image (the first environmental information), and that an illumination result of the target region A1 complies with the default specification. Here, the default specification may be, for example, a parameter threshold value, such as a luminance, an illumination, an irradiated region, etc., regulated in regulations of the required road illumination in every country.

Figure 5:
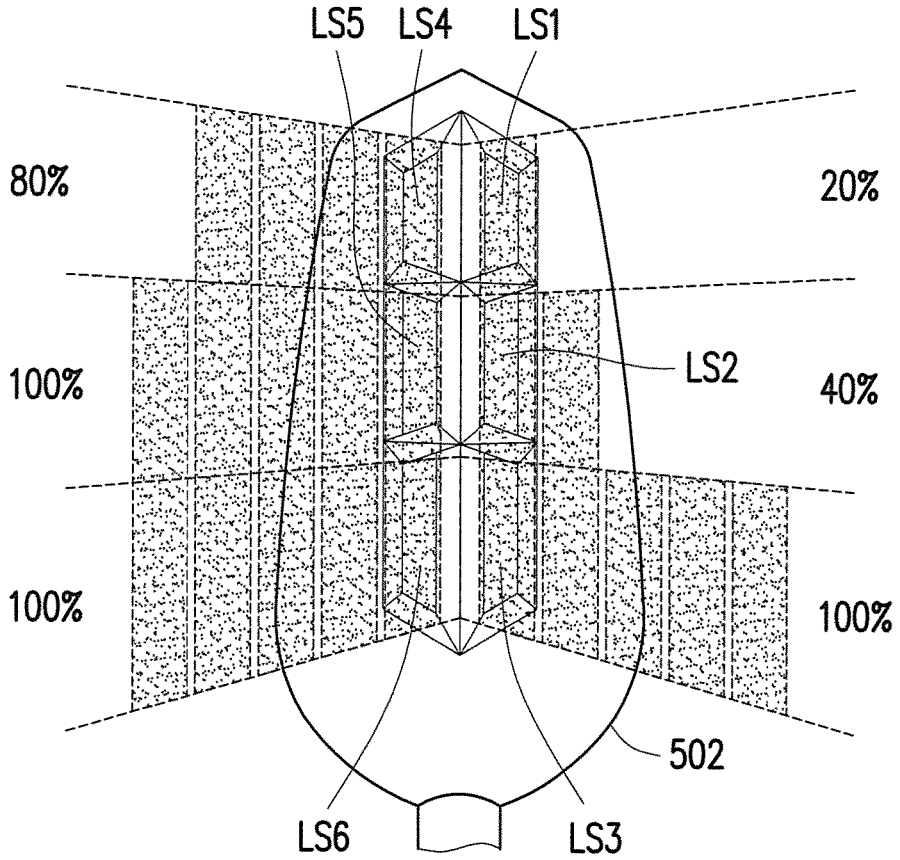
FIG. 5 is a schematic diagram illustrating an illumination apparatus according to an embodiment of the invention.

Here, the illumination character of the illumination light L1 may include, for example, at least one of an angle of incidence at which the illumination light L1 enters the target region A1, a wavelength of the illumination light L1, and a light intensity of the illumination light L1. For example, FIG. 5 is a schematic diagram illustrating an illumination apparatus according to an embodiment of the invention, wherein an illumination apparatus 502 includes six light emitting elements LS1 to LS6 (but not limited hereto), and each light emitting element LS1 to LS6 may be implemented in form of an LED (light emitting diode) array, for example; moreover, the number of the LEDs in the LED array and a wavelength of an illumination light generated by each LED in the LED array may be adjusted by the control circuit 106 according to the illumination result prediction model and the captured image, so as to control an illumination intensity and the wavelength of the illumination light of each of the light emitting elements LS1 to LS6 (e.g., light emitting energy of the light emitting elements LS1 and LS2 are respectively adjusted to 20% and 40% of maximum light emitting energy). In some embodiments, each light emitting element, from LS1 to LS6, may further be equipped with a rotatable mechanism or a reflective plate (not shown), and a position or a light path of the light emitting element, from LS1 to LS6, is adjusted or changed through adjusting the rotatable mechanism or a rotation angle of the reflective plate, so as to change the angle of incidence at which the illumination light produced by the light emitting elements LS1 to LS6 enters the target region A1.

It is worth noting that a weather condition may affect how the control circuit 106 selects an illumination result prediction model. For example, a humidity level of a road surface may differ slightly when the weather is foggy or clear, but the difference between a captured image and a default image is significant. In some embodiments, the first environment information may further include information of a weather condition in addition to the light reflective character of the target region. For example, the environment detection unit 104 may further include a humidity sensor, and the humidity along with the image capturing apparatus and the humidity sensor may be configured to detect whether a fog is generated. When the control circuit 106 determines that a fog is generated, the control circuit 106 controls the illumination apparatus 102 to change the wavelength of the illumination light, so as to increase a light penetration, achieve a better illumination effect, and further enhance an illumination quality.

Figure 6:
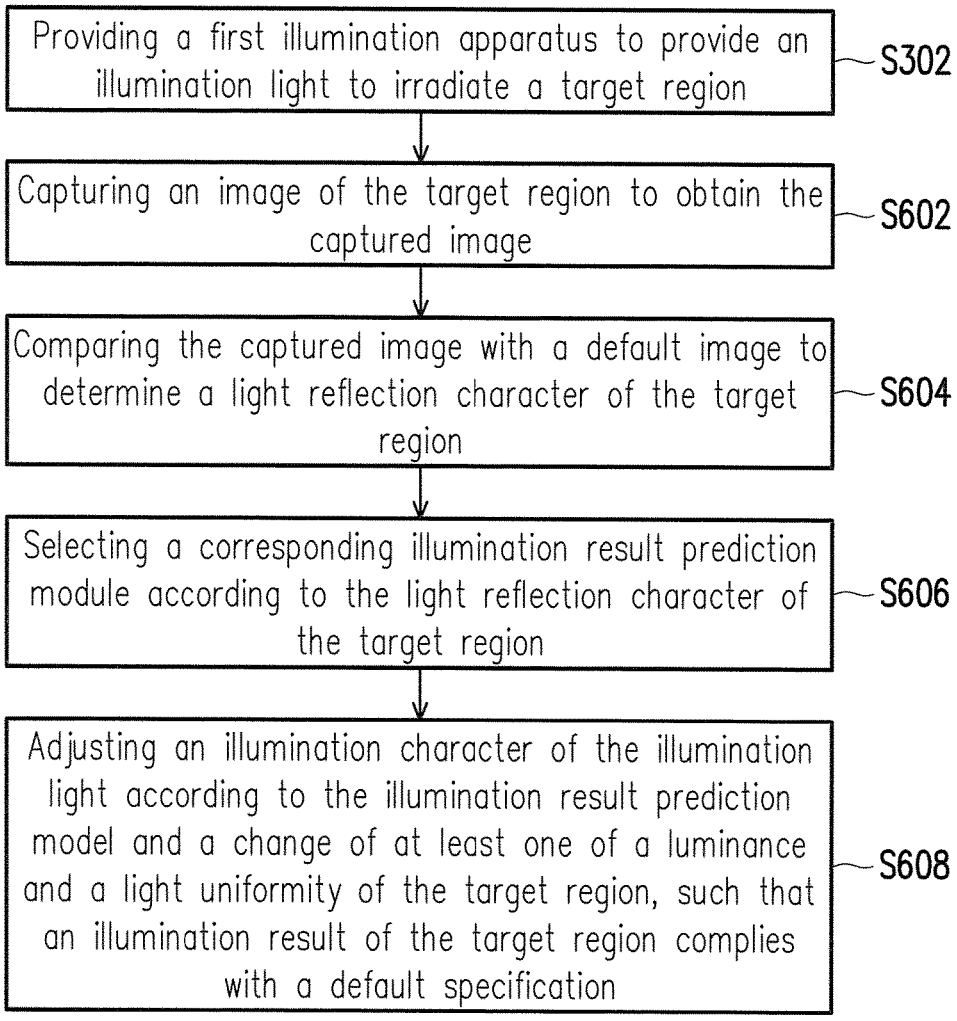
FIG. 6 is a flow chart illustrating an illumination method of an illumination system according to another embodiment of the invention.

FIG. 6 is a flow chart illustrating an illumination method of an illumination system according to another embodiment of the invention. The environmental condition of the position of the first illumination apparatus may be detected, for example, by capturing an image according to the above embodiments. As shown in FIG. 6, after step S302, the image of the target region is captured for acquiring the captured image (S602), and then the captured image and the default image are compared, so as to determine the light reflection character of the target region (S604). Then, a corresponding illumination result prediction model (S606) is selected according to the light reflection character of the target region, wherein the illumination result prediction model, for example, may be configured to predict a light scattering condition when the light irradiates the target region, and the illumination result prediction model may be configured to predict an illumination condition under different weather conditions in some embodiments, for example, the light penetration rate of the illumination light under a foggy condition; moreover, the illumination result of the target region may include at least one of the luminance and the light uniformity of the target region. Finally, the illumination character of the illumination light is adjusted according to the illumination result prediction model and a change of at least one of the luminance and the light uniformity of the target region, such that the illumination result of the target region complies with the default specification (S608). For example, the illumination character of the illumination light may be adjusted to resolve problems including insufficient brightness or generation of glare, wherein the illumination character of the illumination light may include at least one of an angle of incidence at which the illumination light enters the target region, a wavelength of the illumination light, and a light intensity of the illumination light.

Figure 7:
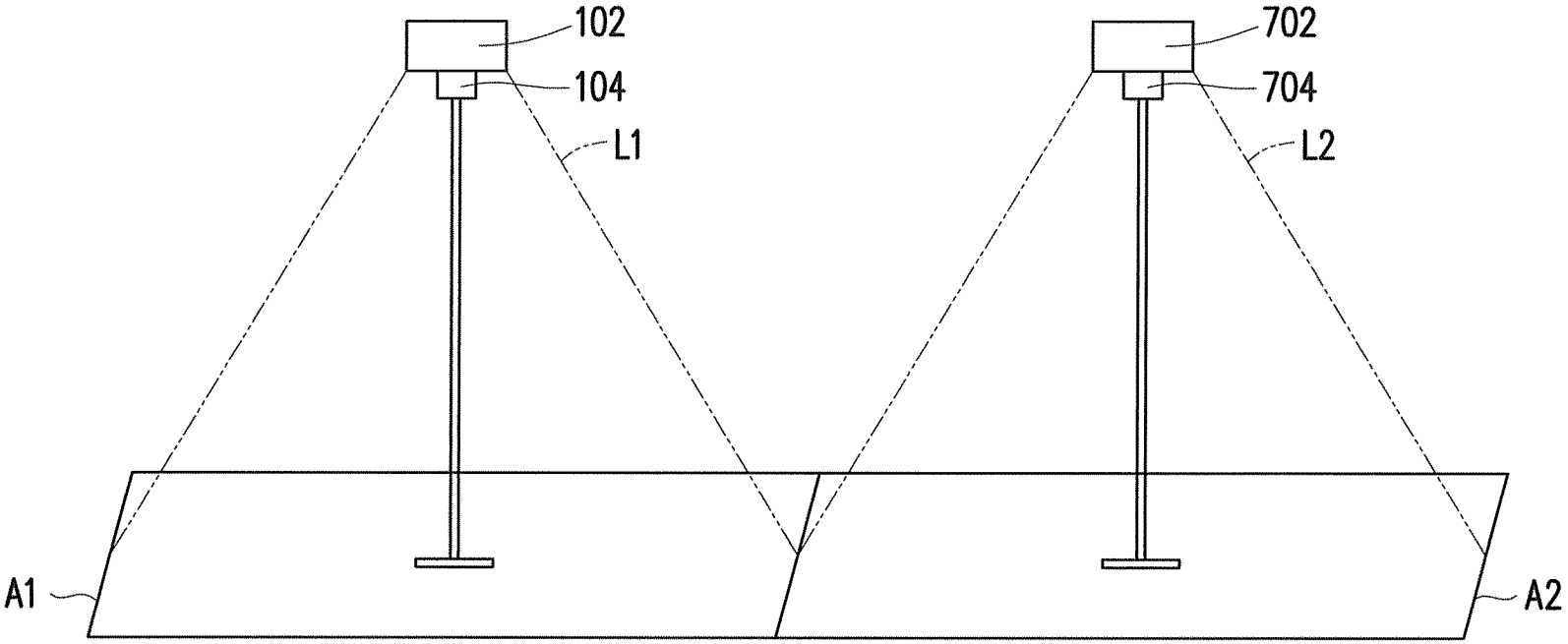
FIG. 7 is a schematic diagram illustrating an illumination system according to another embodiment of the invention.

FIG. 7 is a schematic diagram illustrating an illumination system according to another embodiment of the invention. Referring to FIG. 7, in the embodiment, the illumination character of the illumination light L1 may be adjusted by the control circuit 106 (not shown in FIG. 7) by further referencing to an environmental information of an adjacent illumination apparatus. Just as shown in FIG. 7, the illumination system includes another illumination apparatus 702 and another environmental detection unit 704, and the illumination apparatus 702 is disposed at a default distance (e.g., 50 meters, but not limited hereto) from an illumination apparatus 102. The detailed implementation method of the illumination apparatus 702 and the environmental detection unit 704 is similar to that provided in the above embodiments, and therefore further description is deemed not necessary. The environmental detection unit 704 is configured to detect an environmental condition of a position of the illumination apparatus 702, so as to produce a second environmental information (e.g., a captured image of the target region A2 irradiated by the illumination light L2 of the illumination apparatus 702) and transmit the second environmental information to the environmental detection unit 104, such that the control circuit 106 selects the corresponding illumination result prediction model according to the first environmental information and the second environmental information and adjusts the illumination character of the first illumination light L1 according to the illumination result prediction model, the first environmental information, and the second environmental information. Thereby, the illumination result of the first target region A1 complies with the default specification. Since the illumination apparatus 702 is close to the illumination apparatus 102, the two apparatuses share similar environmental conditions; therefore, the illumination character of the illumination light L1 may be adjusted by the control circuit 106 according to the first environmental information and the second environmental information at the same time, and a misjudgment on the environmental condition may thus be reduced. In addition, when the environmental detection unit 104 breaks down, the illumination character of the illumination light L1 may still be adjusted by the control circuit 106 according to the second environmental information provided by the adjacent environmental detection unit 704. As such, an illumination malfunction of the illumination system is significantly reduced as a result, while an illumination quality is maintained effectively.

Figure 8:
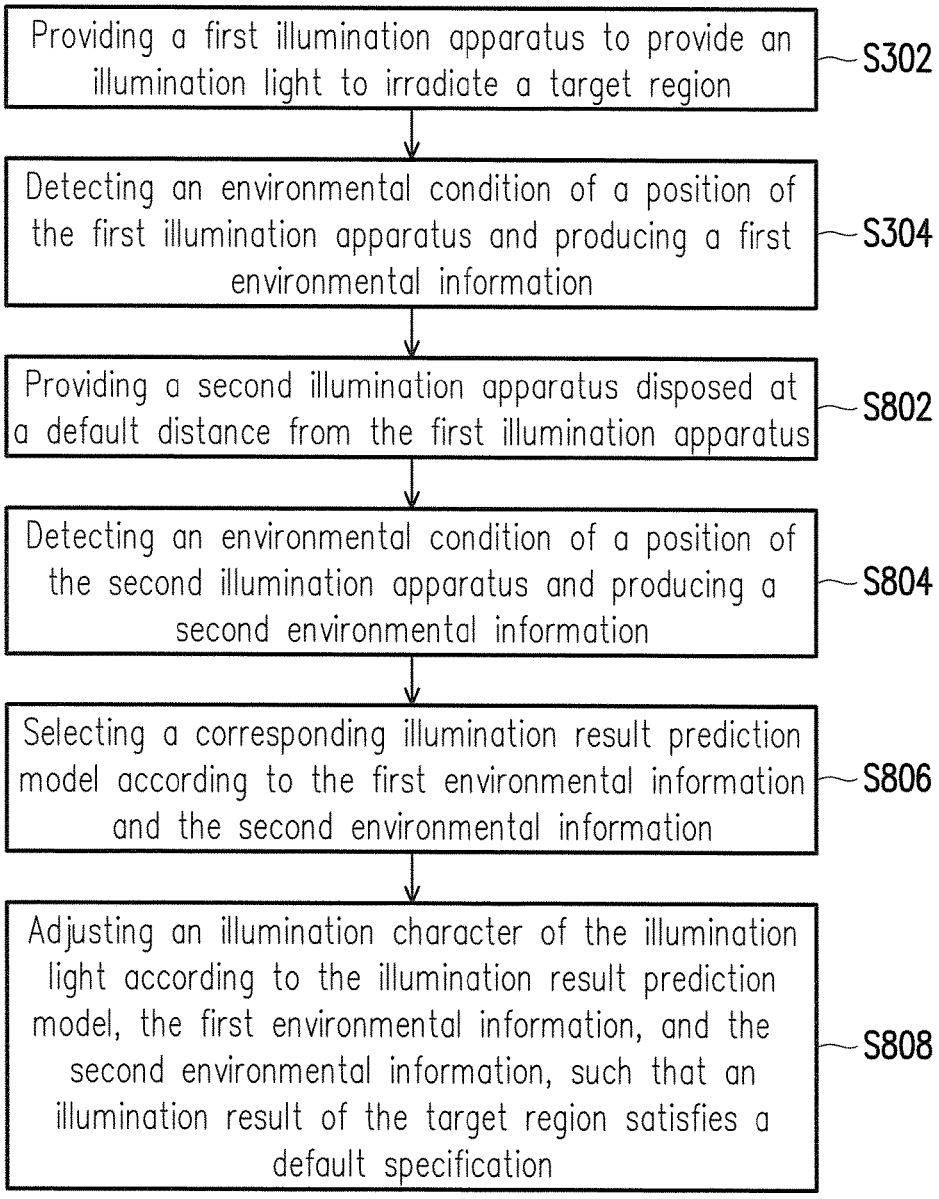
FIG. 8 is a flow chart illustrating an illumination method of an illumination system according to another embodiment of the invention.

FIG. 8 is a flow chart illustrating an illumination method of an illumination system according to another embodiment of the invention. The illumination system further includes a second illumination apparatus according to the embodiment. That is, after step S304, a second illumination apparatus (step S802) disposed at a default distance from the first illumination apparatus is provided, wherein the second illumination apparatus is configured to provide another illumination light irradiating a corresponding target region. Then, the environmental condition of the position of the second illumination apparatus is detected, so as to produce a second environmental information (step S804), wherein the second environmental information may include, for example, at least one of a light reflection character of the target region and a weather condition. Next, a corresponding illumination result prediction model is selected according to the first environmental information and the second environmental information (step S806). Finally, the illumination character of the illumination light is adjusted according to the illumination result prediction model, the first environmental information, and the second environmental information, such that the illumination result of the target region complies with the default specification (step S808).

Overall, in the embodiments of the invention, the corresponding illumination result prediction model is selected according to the environmental condition, and the illumination character of the illumination light is adjusted according to the illumination result prediction model and the environmental condition, such that the illumination result of the target region complies with the default specification. Moreover, an illumination adjustment may be performed immediately corresponding to the environmental condition, thus achieving expected illumination result precisely and enhancing illumination quality considerably. In some embodiments, the illumination character of the illumination light may also be adjusted according to the second environmental information provided by the adjacent environmental detection unit, so as to lower a chance of malfunction of the illumination system and maintain the illumination quality effectively.

It will be apparent to those skilled in the art that various modifications and variations can be made to the disclosed embodiments without departing from the scope or spirit of the invention. In view of the foregoing, it is intended that the invention covers modifications and variations provided that they fall within the scope of the following claims and their equivalents.

What is claimed is:

1. An illumination system, comprising:

a first illumination apparatus, providing a first illumination light irradiating a first target region;

a first environmental detection unit, detecting an environmental condition of a position of the first illumination apparatus, so as to produce a first environmental information; and a control circuit, coupled to the first illumination apparatus and the first environmental detection unit and configured to choose a corresponding illumination result prediction model according to the first environmental information and adjust an illumination character of the first illumination light according to the illumination result prediction model and the first environmental information, such that an illumination result of the first target region complies with a default specification, wherein the default specification comprises at least one illumination parameter, wherein the first environmental information comprises a scattering light after the first illumination light enters a road surface.

2. The illumination system as claimed in claim 1, further comprising:

a second illumination apparatus, disposed at a default distance from the first illumination apparatus and configured to provide a second illumination light irradiating a second target region; and a second environmental detection unit, detecting an environmental condition of a position of the second illumination apparatus, so as to produce a second environmental information and transmit the second environmental information to the first environmental detection unit, wherein the control circuit chooses a corresponding illumination result prediction model according to the first environmental information and the second environmental information and adjusts the illumination character of the first illumination light according to the illumination result prediction model, the first environmental information, and the second environmental information, such that the illumination result of the first target region complies with the default specification.

3. The illumination system as claimed in claim 1, wherein the first environmental information comprises at least one of a light reflection character of the first target region and a weather condition.

4. The illumination system as claimed in claim 3, wherein the first environmental detection unit comprises an image capturing apparatus, and the control circuit controls the image capturing apparatus to capture an image of the first target region, obtain a captured image, and compare the captured image with a default image, so as to determine a light reflection character of the first target region and choose a corresponding illumination result prediction model according to the light reflection character of the first target region.

5. The illumination system as claimed in claim 1, wherein the first environmental detection unit comprises a humidity sensor.

6. The illumination system as claimed in claim 1, wherein the illumination result of the first target region comprises at least one of a luminance and a light uniformity of the first target region, and the control circuit further adjusts the illumination character of the first illumination light according to a change of the at least one of the luminance and the light uniformity of the first target region, such that the illumination result of the first target region complies with the default specification.

7. The illumination system as claimed in claim 1, wherein the illumination character of the first illumination light comprises at least one of an angle of incidence at which the first illumination light enters the first target region, a wavelength of the first illumination light, and a light intensity of the first illumination light.

8. The illumination system as claimed in claim 1, wherein the first illumination apparatus comprises light emitting elements equipped with a rotatable mechanism or a reflective plate, wherein a position or a light path of the light emitting element is adjusted or changed through adjusting the rotatable mechanism or a rotation angle of the reflective plate.

9. An illumination method of an illumination system, comprising:

providing a first illumination apparatus to provide a first illumination light to irradiate a first target region;

detecting an environmental condition of a position of the first illumination apparatus and producing a first environmental information;

selecting a corresponding illumination result prediction model according to the first environmental information; and adjusting an illumination character of the first illumination light according to the illumination result prediction model and the first environmental information, such that an illumination result of the first target region complies with a default specification, and that the default specification comprises at least one illumination parameter, wherein the first environmental information comprises a scattering light after the first illumination light enters a road surface.

10. The illumination method of the illumination system as claimed in claim 9, further comprising:

providing a second illumination apparatus disposed at a default distance from the first illumination apparatus, wherein the second illumination apparatus provides a second illumination light irradiating a second target region;

detecting an environmental condition of a position of the second illumination apparatus, so as to produce a second environmental information;

selecting a corresponding illumination result prediction model according to the s environmental information and the second environmental information; and adjusting an illumination character of the first illumination light according to the illumination result prediction model, the first environmental information, and the second environmental information, such that the illumination result of the first target region complies with the default specification.

11. The illumination method of the illumination system as claimed in claim 9, wherein the first environmental information comprises at least one of a light reflection character of the first target region and a weather condition.

12. The illumination method of the illumination system as claimed in claim 11, wherein the step of detecting the environmental condition comprises:

capturing an image of the first target region for acquiring a captured image;

comparing the captured image with a default image for determining the light reflection character of the first target region; and selecting a corresponding illumination result prediction model according to the light reflection character of the first target region.

13. The illumination method of the illumination system as claimed in claim 9, wherein the first environmental information comprises an environmental humidity.

14. The illumination method of the illumination system as claimed in claim 9, wherein the illumination result of the first target region comprises at least one of a luminance and a light uniformity of the first target region, and the illumination method of the illumination system comprises:

adjusting the illumination character of the first illumination light according to the illumination result prediction model and a change of the at least one of the luminance and the light uniformity of the first target region, such that the illumination result of the first target region complies with the default specification.

15. The illumination method of the illumination system as claimed in claim 9, wherein the illumination character of the first illumination light comprises at least one of an angle of incidence at which the first illumination light enters the first target region, a wavelength of the first illumination light, and a light intensity of the first illumination light.

16. The illumination method as claimed in claim 9, wherein the first illumination apparatus comprises light emitting elements equipped with a rotatable mechanism or a reflective plate, wherein a position or a light path of the light emitting element is adjusted or changed through adjusting the rotatable mechanism or a rotation angle of the reflective plate.

* * * * *